US006749318B1

(12) United States Patent
Palacios

(10) Patent No.: US 6,749,318 B1
(45) Date of Patent: Jun. 15, 2004

(54) LIGHTED HAND TOOL

(76) Inventor: Josue Palacios, 5220 BroadmooreBluffs Dr., Colorado Springs, CO (US) 98903

( * ) Notice: Subject to any disclaimer, the term of this patent is extended or adjusted under 35 U.S.C. 154(b) by 0 days.

(21) Appl. No.: 10/268,301

(22) Filed: Oct. 11, 2002

(51) Int. Cl.[7] ..... B26B 11/00

(52) U.S. Cl. ..... 362/119; 362/253; 81/490; 30/169; 7/167

(58) Field of Search ..... 362/119, 253; 81/490; 30/169; 7/167

(56) References Cited

U.S. PATENT DOCUMENTS 1,517,153 A 11/1924 Devine
1,890,841 A 12/1932 Brown
4,656,566 A 4/1987 Kelley
5,313,376 A 5/1994 McIntosh
5,332,389 A 7/1994 Rosenstatter
5,402,575 A 4/1995 Maxcy
D365,163 S 12/1995 Brogliato
5,539,624 A 7/1996 Dougherty
5,964,517 A 10/1999 Adams
6,027,224 A * 2/2000 Schnell ..... 362/119
6,341,423 B1 * 1/2002 Taggart et al. ..... 30/169
6,655,243 B2 * 12/2003 Anderson et al. ..... 81/490

* cited by examiner

*Primary Examiner*—Stephen Huon
*Assistant Examiner*—James W Cranson
(74) *Attorney, Agent, or Firm*—Donald R. Schoonover

(57) ABSTRACT

A hand tool includes a highly focused light as well as a display. The hand tool can include a plurality of different tools, and includes a polygonal housing and a conical nose section as well as an easily gripped outer surface which includes gripping protrusions.

7 Claims, 2 Drawing Sheets

LIGHTED HAND TOOL

BACKGROUND OF THE INVENTION

1. Field of the Invention

The present invention relates to the general art of hand tools, and to the particular field of multipurpose hand tools.

2. Discussion of the Related Art

More and more people are spending time out of doors. This includes both recreation and work. Thus, hiking, camping, fishing, climbing, backpacking, and the like, join traditional out-of-doors work activities such as farming in bringing people out of doors.

Many, if not all, of these outdoor activities often require the use of some sort of hand tool. For example, fisherman often require the use of a knife or a hook removing tool or the like, while others may require the use of screw drivers, tweezers, forks, can openers, bottle openers, pliers, eating utensils and the like.

Thus, the art contains many examples of multipurpose tools that can be used in such conditions.

However, many of these activities are carried out in low light conditions, such as at night or at dawn or at dusk. This is especially true of fishing. Low light conditions may hamper use of these tools. Thus, the art also contains hand tools that are combined with light sources.

However, these light sources are generally simply light bulbs and are not sharply focused on the work area. Thus, while somewhat helpful, these lights suffer drawbacks.

Therefore, there is need for a hand tool that is combined with a highly focused light.

Often, hand tools are used in less than ideal conditions. These conditions often include rain, sleet, snow and the like. Under such harsh conditions, it is easy to drop the tool. Thus, hand tools that are intended to be used in harsh environmental conditions should be easy to securely grasp, yet also be rugged to survive an impact if dropped. Sometimes these conditions are mutually exclusive.

Therefore, there is a need for a hand tool that is combined with a light and which can be securely gripped and still be sufficiently rugged to survive an impact if dropped.

Many hand tool users need to know some information about their surroundings. For example, a fisherman may want to know the temperature, a climber may want to know his altitude, or the like. While the art contains separate thermometers and separate altimeters, these separate instruments present problems. Any additional equipment that must be carried presents problems, including the loss of that equipment as well as the damaging of that equipment.

Therefore, there is a need for a hand tool that is combined with a light and which can also be combined with a measuring instrument, such as a compass or a thermometer or an altimeter.

PRINCIPAL OBJECTS OF THE INVENTION

It is a main object of the present invention to provide a hand tool combined with a light.

It is another object of the present invention to provide a hand tool combined with a light that can be used for both recreation and for work.

It is another object of the present invention to provide a hand tool combined with a sharply focused light.

It is another object of the present invention to provide a hand tool combined with a light that is easily gripped.

It is another object of the present invention to provide a hand tool combined with a light that includes a display for data.

It is another object of the present invention to provide a hand tool combined with a light that includes a compass.

It is another object of the present invention to provide a hand tool combined with a light that includes an altimeter.

It is another object of the present invention to provide a hand tool combined with a light that includes a thermometer.

It is another object of the present invention to provide a hand tool combined with a light that is rugged and readily absorbs shocks.

It is another object of the present invention to provide a hand tool combined with a light that can be used by fisherman.

SUMMARY OF THE INVENTION

These, and other, objects are achieved by a hand tool that is combined with a highly focused light and which includes a rubberized outer surface that is easily and securely gripped. A lens focuses the light in the manner necessary to provide a highly focused beam of light for the tool. The hand tool includes a display that can be connected to a thermometer or an altimeter or a compass and can contain a multiplicity of tools that can be slid into and out of the knife as needed. The knife is rugged and thus can stand a great deal of abuse and still function. Thus, the knife is useful in both the recreational and the work environments.

BRIEF DESCRIPTION OF THE DRAWING FIGURES

DETAILED DESCRIPTION OF THE INVENTION

Other objects, features and advantages of the invention will become apparent from a consideration of the following detailed description and the accompanying drawings.

Figure 1:
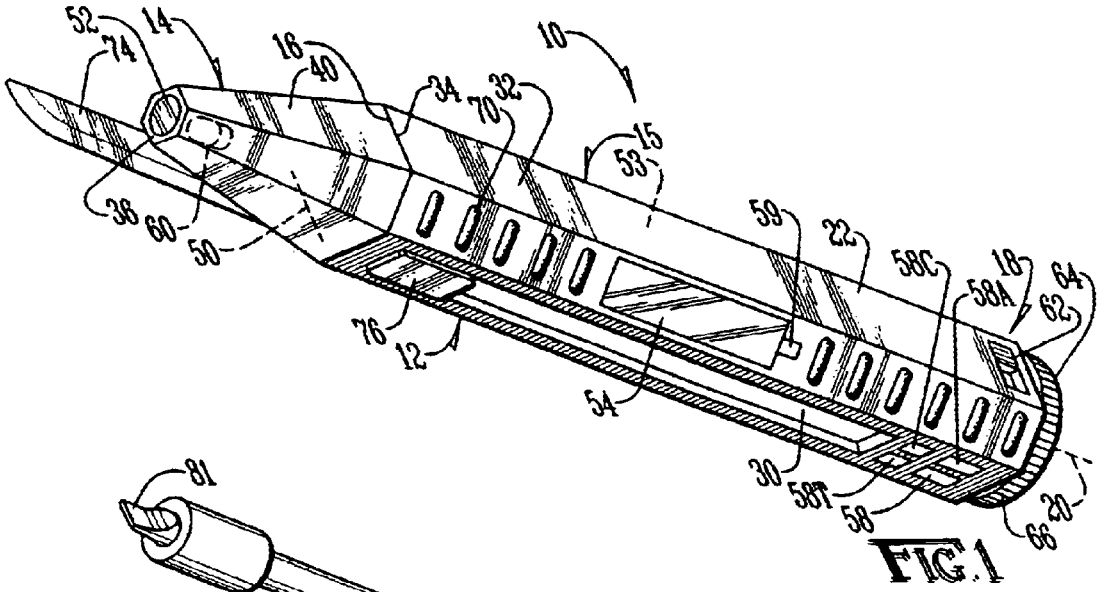
FIG. 1 is a perspective view of a hand tool combined with a light embodying the present invention.
Figure 2A:
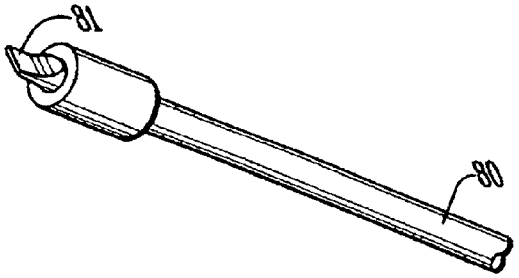
FIGS. 2A–2I are perspective views of various tools that can be used in connection with the hand tool shown in FIG. 1.
Figure 2B:
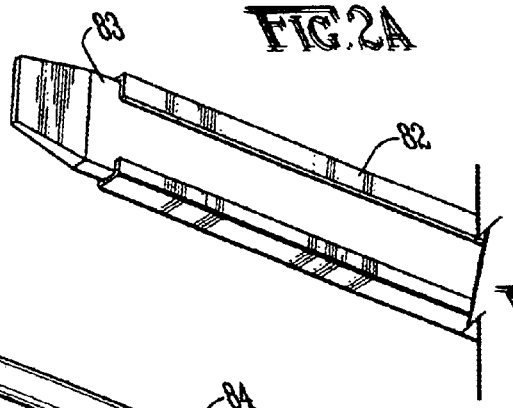
Figure 2C:
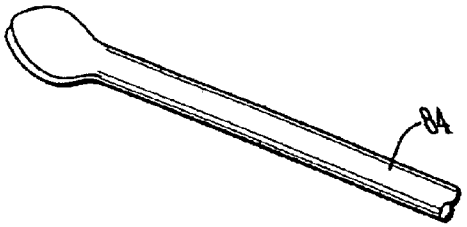
Figure 2D:
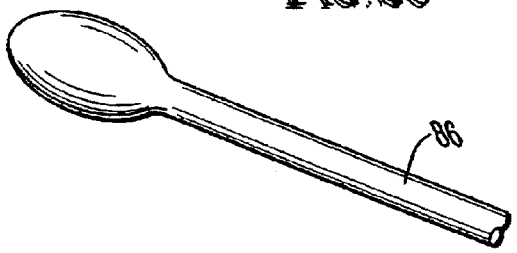
Figure 2E:
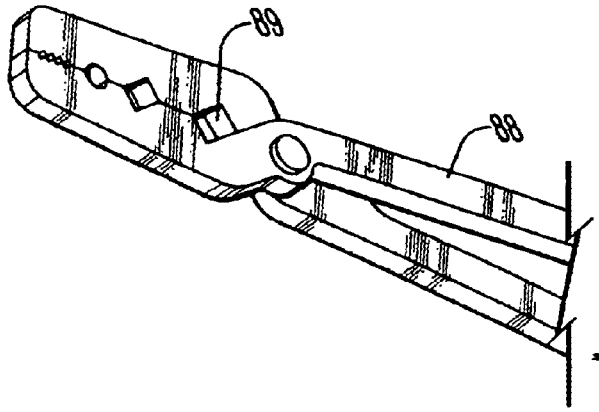
Figure 2F:
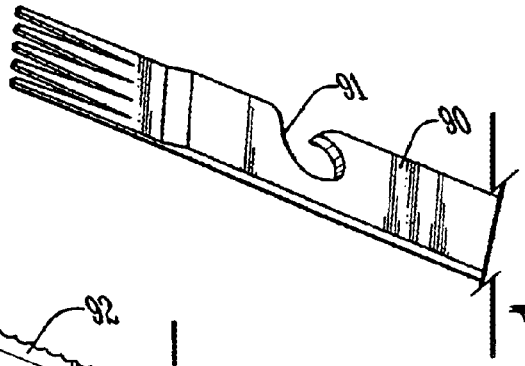
Figure 2G:
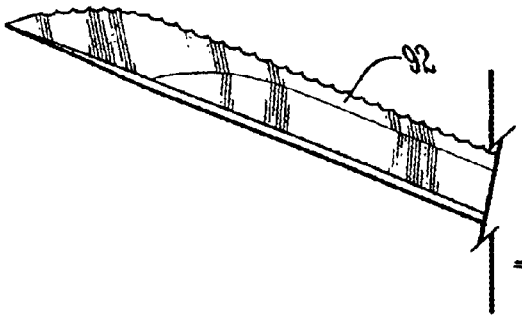
Figure 2H:
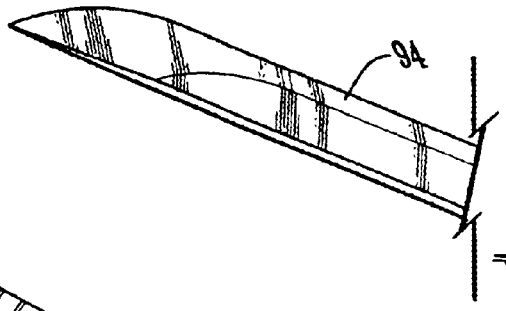
Figure 2I:
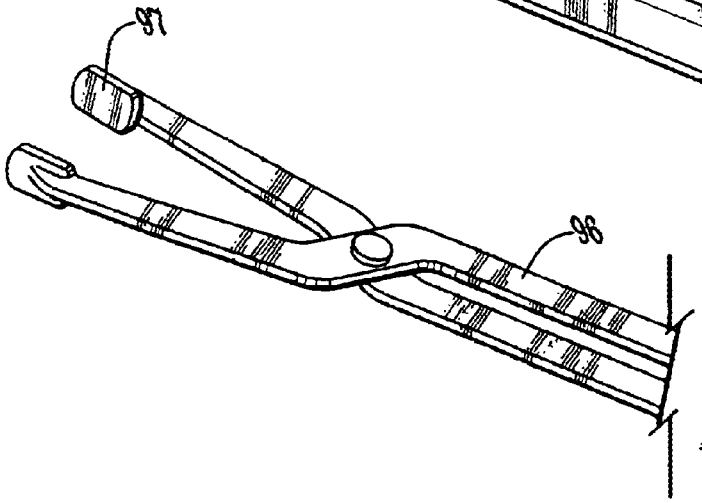

Referring to FIG. 1, it can be understood that the present invention is embodied in a hand tool 10 which comprises a hand grip portion 12 and a conical nose section 14. Hand grip portion 12 includes a polygonal housing 14 having a first end 16, a second end 18 and a longitudinal axis 20 extending between the first end 16 of the polygonal housing 15 and the second end 18 of the polygonal housing 15. A plurality of planar side sections, such as side section 22, extend in the direction of the longitudinal axis 20 from the first end 16 of the housing 15 to the second end 18 of the housing 15. There are eight side sections 22 in the form shown in FIG. 1.

A slot 30 is defined through one of the planar side sections 22 to extend in the direction of the longitudinal axis 20 of the housing 15, and a rubberized outer surface 32 is on the polygonal housing 15 to facilitate gripping of the hand tool 10.

Nose section 14 is located on the first end 16 of the housing 15, and is in the form of a truncated cone having a base 34 fixed to the first end 16 of the housing 15 and an apex 36 spaced apart from the first end 16 of the housing 15 in the direction of the longitudinal axis 20 of the housing 15.

Apex 36 is planar and is oriented transverse to the longitudinal axis 20 of the housing 15.

A plurality of planar surfaces, such as planar surface 40, extend from the apex 36 of the nose section 14 to the base 34 of the nose section 14. Planar surfaces 40 are each oriented to be a continuation of a corresponding one of the plurality of planar side sections of the housing. Thus, planar surface 40 is a continuation of planar side section 22. The planar surfaces 40 of the nose section 14 converge toward each other from the base 34 of the nose section 14 to the apex 36 of the nose section 14.

A slot 50 is defined through one planar surface of the plurality of planar surfaces of the nose section 14. Slot 50 extends transverse to the longitudinal axis 20 of the housing 15 and is used for a purpose that will be understood from the teaching of this disclosure.

A lens 52 is located in the apex 36 of the nose section 14 and serves to sharply focus light passing therethrough.

Tool 10 further includes a hollow interior 53 inside the housing 15 and inside the nose section 14. Power sources, such as batteries, are located in the hollow interior 53 as are circuits and the like.

A display 54 is located on one planar side section of the housing 15 and is used to display data such as temperature, altitude, direction and the like as sensed by instruments associated with tool 10. The sensing instruments can be located inside the housing 15, or on the housing 15 such as sensor 58 which can be a thermometer or a compass or an altimeter. The sensors are connected to the display 54 and to the power source and to a switch by suitable circuits, such as circuit 59, and include a thermometer 58T, an altimeter 58A and/or a compass 58C.

A light bulb 60 is located inside the nose section 14 adjacent to lens 52 to emit light that is focused by the lens 52.

An on/off switch 62 is located on the second end 18 of the housing 15. On/off switch 62 is electrically connected to the light bulb 60 and to any sensor circuits associated with the tool to electrically connect the light bulb 60 or the sensor circuits to the power supply when the on/off switch 62 is in an "on" condition.

A removable cap 64 is removably mounted on the second end 18 of the housing 15 and provides access to the interior of the housing 15 as necessary. Knurling 66 is located on the cap 64 to facilitate rotation of the cap 64 onto and off of the housing 15.

A plurality of grip-enhancing protrusions 70 are located on one planar side section of the plurality of planar side sections to further secure the grip of a user on the hand tool 10. The protrusions can be formed of rubber or the like.

A tool 74 is slidably mounted on the nose section 14 and on the housing 15. Tool 74 is slidable in the direction of longitudinal axis 20 between a stored position inside the housing 15 and a deployed position (shown in FIG. 1) extending through slot 50 defined in the nose section 14 and partially extends out of the nose section 14. A handle 76 is fixed to tool 74 for movement therewith. Handle 76 extends through slot 30 to be gripped by a user to move the tool from the stored position to the deployed position.

Various tools can be used with hand tool 10. These tools can be used individually or in combination. Thus, while a single tool is shown in FIG. 1, no limitation is intended thereby and such showing is for the sake of convenience. Some of the various tools that can be used in conjunction with hand tool 10 are shown in FIG. 2A through FIG. 2I and include a screwdriver 80 with removable tips 81 and which can be magnetic, a removable carbide coated sharpener 82 mounted on a slide 83, a fishhook removing tool 84, an eating utensil such as a spoon 86, locking pliers 88 with a wire stripper 89, a fork 90 with a bottle opener 91, a serrated blade 92, a plain blade 94 and scissors 96 with nose plier tips 97.

It is to be understood that while certain forms of the present invention have been illustrated and described herein, it is not to be limited to the specific forms or arrangements of parts described and shown.

What is claimed and desired to be covered by Letters Patent is:

1. A hand tool comprising:

a) a hand grip portion which includes
  (1) a polygonal housing having
    (A) a first end,
    (B) a second end,
    (C) a longitudinal axis extending between the first end of the polygonal housing and the second end of the polygonal housing,
    (D) a plurality of planar side sections extending in the direction of the longitudinal axis from the first end of the housing to the second end of the housing,
    (E) a slot defined through one of the planar side sections to extend in the direction of the longitudinal axis of the housing, and
    (F) a rubberized outer surface on the polygonal housing, and
  (2) a nose section located on the first end of the housing, the nose section being in the form of a truncated cone and having
    (A) a base fixed to the first end of the housing,
    (B) an apex spaced apart from the first end of the housing in the direction of the longitudinal axis of the housing, the apex being planar and oriented transverse to the longitudinal axis of the housing,
    (C) a plurality of planar surfaces which extend from the apex of the nose section to the base of the nose section, and are each oriented to be a continuation of a corresponding one of the plurality of planar side sections of the housing, the planar surfaces of the nose section converging toward each other from the base of the nose section to the apex of the nose section, and
    (D) a slot defined through one planar surface of the plurality of planar surfaces of the nose section, the slot of the nose section extending transverse to the longitudinal axis of the housing;
b) a lens in the apex of the nose section;
c) a hollow interior in the housing and in the nose section;
d) a display on one planar side section of the housing;
e) a sensor in the housing, said sensor being electrically connected to said display;
f) a light bulb in the nose section adjacent to said lens;
g) a power supply in the housing;
h) an on/off switch on the second end of the housing, said on/off switch being electrically connected to said light bulb to electrically connect said light bulb to said power supply when said on/off switch is in an "on" condition;
i) a removable cap removably mounted on the second end of the housing;

j) a plurality of grip-enhancing protrusions on one planar side section of the plurality of planar side sections;

k) a tool slidably mounted on the nose section and on the housing, said tool being slidable in the direction of the longitudinal axis between a stored position inside the housing and a deployed position extending through the slot defined in the nose section and partially extending out of the nose section; and 1) a handle fixed to said tool for movement therewith, said handle extending through the slot defined through one planar side section of the housing.

2. The hand tool as described in claim 1 further including a second tool slidably mounted on the nose section and on the housing.

3. The hand tool as described in claim 1 further including a thermometer on the housing and connected to the display on the housing.

4. The hand tool as described in claim 1 further including an altimeter on the housing and connected to the display on the housing.

5. The hand tool as described in claim 1 further including a compass on the housing and connected to the display on the housing.

6. The hand tool as described in claim 1 further including said removable cap.

7. The hand tool as described in claim 1 wherein said tool screwdriver having a magnetic tip.

* * * * *